US011851937B2

(12) United States Patent
Bauer

(10) Patent No.: US 11,851,937 B2
(45) Date of Patent: Dec. 26, 2023

(54) METHOD FOR CONTROLLING A MOTORIZED FLAP ARRANGEMENT OF A MOTOR VEHICLE

(71) Applicant: Brose Fahrzeugteile SE & Co. Kommanditgesellschaft, Bamberg, Bamberg (DE)

(72) Inventor: Franz Bauer, Coburg (DE)

(73) Assignee: Brose Fahrzeugteile SE & Co. Kommanditgesellschaft, Bamberg, Bamberg (DE)

( * ) Notice: Subject to any disclaimer, the term of this patent is extended or adjusted under 35 U.S.C. 154(b) by 90 days.

(21) Appl. No.: 17/350,124

(22) Filed: Jun. 17, 2021

(65) Prior Publication Data

US 2021/0396066 A1 Dec. 23, 2021

(30) Foreign Application Priority Data

Jun. 17, 2020 (DE) ..... 10 2020 116 025.9

(51) Int. Cl.
*E05F 15/00* (2015.01)
*E05F 15/73* (2015.01)

(52) U.S. Cl.
CPC ..... *E05F 15/73* (2015.01); *E05Y 2201/224* (2013.01); *E05Y 2201/41* (2013.01); *E05Y 2201/422* (2013.01); *E05Y 2400/354* (2013.01); *E05Y 2400/812* (2013.01); *E05Y 2400/818* (2013.01); *E05Y 2900/546* (2013.01)

(58) Field of Classification Search
CPC ..... E05F 15/00; E05F 15/73; E05F 15/70; E05Y 2201/224; E05Y 2201/41; E05Y 2400/422; E05Y 2400/354; E05Y 2400/812; E05Y 2400/818; E05Y 2900/546
USPC ..... 49/31
See application file for complete search history.

(56) References Cited

U.S. PATENT DOCUMENTS

| | | | | |
|---|---|---|---|---|
| 2017/0059112 | A1* | 3/2017 | Yang | F21S 43/40 |
| 2017/0089112 | A1 | 3/2017 | Rosales et al. | |
| 2022/0220792 | A1* | 7/2022 | Schalyo | E05F 15/73 |
| 2022/0235596 | A1* | 7/2022 | Schalyo | E05F 15/614 |
| 2022/0356746 | A1* | 11/2022 | Konchan | E05F 15/70 |

* cited by examiner

*Primary Examiner* — Chi Q Nguyen
(74) *Attorney, Agent, or Firm* — Dickinson Wright PLLC

(57) ABSTRACT

A method for controlling a motorized flap assembly of a motor vehicle, wherein the flap assembly includes a pivotable flap, a drive arrangement associated with the flap and a control arrangement for controlling the drive arrangement. A position sensor for determining position information related to the position of a selected component of the flap assembly is associated with the flap assembly and movement commands for the drive arrangement are generated by the control arrangement based on the position information, to close the flap to an upright closed position during a motorized closing process and to open the flap to a horizontal open position during a motorized opening process. The pivoted open flap may be occupied by an object or a person. The position sensor detects the object or person based on at least one occupancy criterion and an occupancy reaction is triggered depending on the detected occupancy state.

15 Claims, 2 Drawing Sheets

METHOD FOR CONTROLLING A MOTORIZED FLAP ARRANGEMENT OF A MOTOR VEHICLE

CROSS-REFERENCE TO RELATED APPLICATIONS

This application claims priority to German Patent Application No. DE 10 2020 116 025.9, filed on Jun. 17, 2020, the disclosure of which is hereby incorporated in its entirety by reference herein.

TECHNICAL FIELD

The present disclosure relates to a method of controlling a motorized flap assembly of a motor vehicle.

BACKGROUND

The flap assembly in question is equipped with a pivotable flap, which may be pivoted by a drive arrangement between an upright closed position and a horizontal open position. Such flaps may be found, for example, in work vehicles in which the rear area of an open loading area is closed with the flap. Such work vehicles are also referred to as pickup trucks. Other application examples are station wagons in which the rear opening is closed by means of two flaps lying one above the other which may be pivoted horizontally.

The flap may be brought into an open position in which the flap is in a substantially horizontal orientation. The arrangement is such that the flap pivoted open in this way can serve as a shelf, as a bench or the like. It can be occupied accordingly by an object, such as a person.

SUMMARY

An occupancy state of a pivoted open flap can be detected a position sensor associated with the flap assembly. This is because the occupancy of the pivoted open flap by an object, for example a person, leads to characteristic relative movements within the flap assembly with a suitable design, which can be evaluated at a position sensor associated with the flap assembly for detecting the occupancy state.

In detail, it is proposed that the occupancy state regarding the occupancy of the pivoted open flap by an object may be detected by the control arrangement by means of the position sensor according to at least one occupancy criterion and an occupancy reaction is triggered depending on the detected occupancy state. As an example, this makes it possible to avoid accidental motorized adjustment processes when the flap is occupied by an object. As a result, the operational safety of the flap assembly can be increased in a simple way with the teaching according to the proposal.

The term "pivoted open flap" is to be interpreted broadly in this case. In the pivoted open state, the flap 2 occupies a horizontal position, but it does not have to be exactly the open position. As an example, the yet to be explained overtravel position also corresponds to the state of the pivoted open flap according to this wide interpretation.

The term "position sensor" represents a sensor for determining position information related to the position of a selected component of the flap assembly. The term "selected" in this case merely means that the component in question is identifiable as such. A selection step of any kind is not included in this and is not part of the method according to the proposal. The position information may include a position, a slope or the like. However, the position information may also include time derivatives, i.e. velocity and acceleration information. In this respect, the term "position sensor" is to be understood broadly in this case.

The occupancy state to be detected in each case can be defined broadly by means of the at least one occupancy criterion. In a variant to be implemented with little effort, a distinction is only made between the occupancy state of the pivoted out flap when occupied by an object, i.e. the "occupied" occupancy state, and the occupancy state of the unoccupied flap, i.e. the "unoccupied" occupancy state.

In one or more embodiments, a gesture-based adjustment of the flap may be provided, in which in one variant the detection range of the associated gesture sensor at least partly includes the legs of a person sitting on the pivoted open flap. If, for example, a foot movement, such as a kicking movement, would result in triggering a motorized closing process, then the person sitting on the pivoted open flap would run the risk of unintentionally triggering just such a motorized closing movement by dangling his legs. Here, the detection according to the proposal of the occupancy state of the pivoted open flap may have an advantage, since a malfunction as above can be safely avoided by a suitable occupancy reaction which is yet to be explained.

One or more embodiments may be directed to detecting the occupancy state of the pivoted open flap. While the position sensor, such as a Hall sensor element, the position sensor according may be equipped with an inclination sensor element, such as an inertial sensor element. Both sensor variants may be used in each case on their own or in combination for the implementation of the solution according to the proposal.

Detection with the above sensor elements may be made with little effort. This is because the occupancy of the pivoted open flap by an object is accompanied by an adjustment of the flap from an open position to an overtravel position, which can be easily detected by sensor. It may be that the open position and not the overtravel position is approached during the motorized opening process.

The adjustability of the flap from the open position to the overtravel position can be due to mechanical play or freewheeling, without requiring resilient flexibility of the flap assembly 1. However, resilient flexibility, for example due to a spring arrangement, is provided for the adjustability of the flap from the open position to the overtravel position.

One or more embodiments are directed to respective occupancy reaction. Here it becomes clear that with the solution according to the proposal, a wide range of measures can be generated for increasing operational safety, ranging from a simple occupancy message to an operator interface to a suspension of control of the drive arrangement and/or a suspension of gesture recognition. An occupancy reaction may be optimized for the respective individual case results, in that the messages in question may be provided differently to an operator interface or to the further control arrangement depending on the occupancy state and the operating situation.

According to another embodiment, which has independent importance, a computer program product for a control arrangement is provided. Reference may be made to all statements relating to the method according to the proposal and to the control arrangement according to the proposal.

According to another embodiment, which also has independent importance, a computer-readable storage medium on which the computer program product according to the proposal is stored, is provided. Here too, reference may be made to all statements relating to the method according to the proposal.

According to yet another embodiment, which also has independent importance, a motorized flap assembly of a motor vehicle configured to be operated by the method provided above, is provided.

BRIEF DESCRIPTION OF THE DRAWINGS

The invention is explained below in more detail on the basis of a drawing merely representing an exemplary embodiment. In the figures

DETAILED DESCRIPTION

Figure 1:
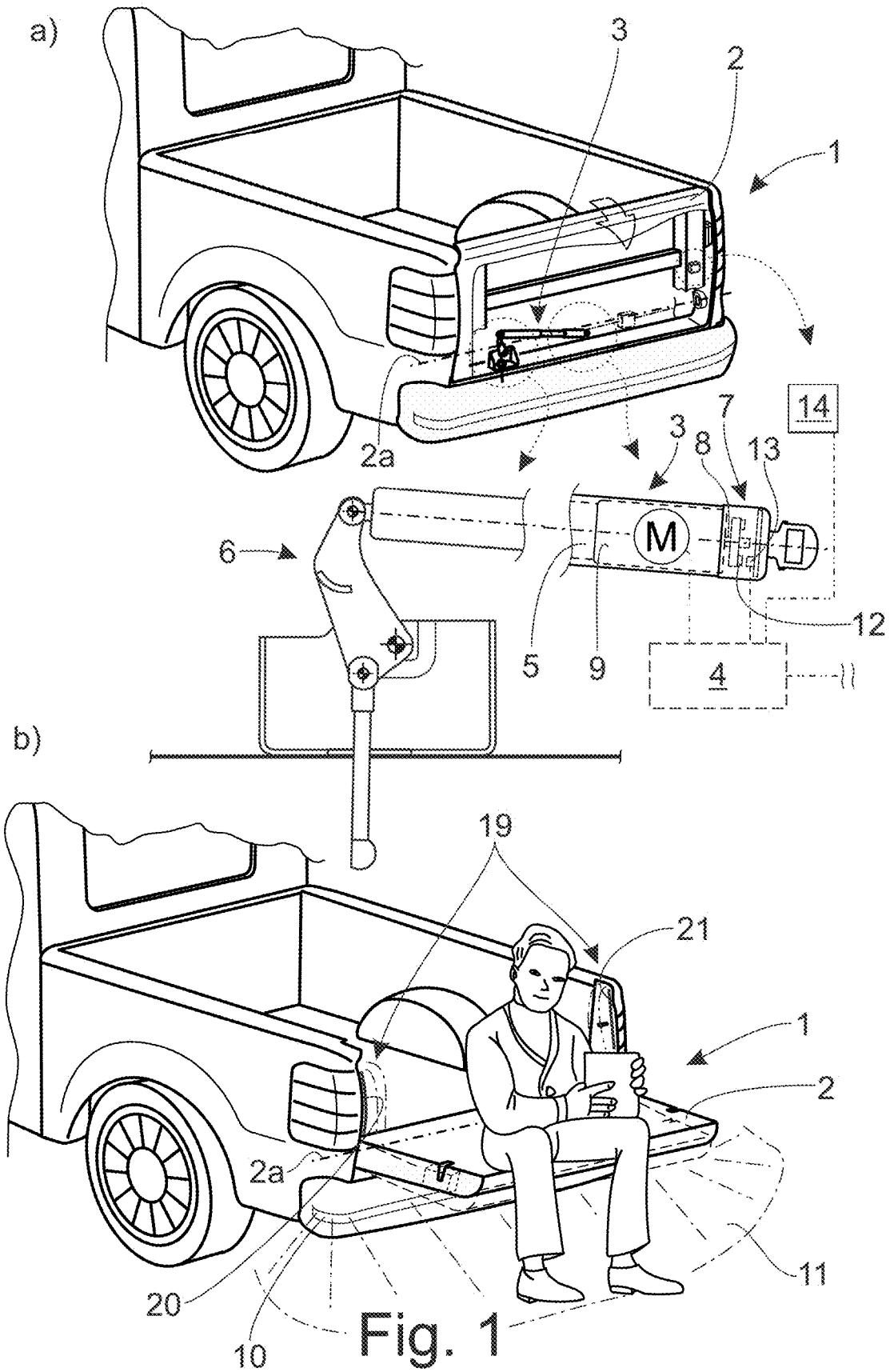
FIG. 1 shows the rear area of a motor vehicle with a flap assembly according to the proposal, which is set up to carry out a method according to the proposal, in a perspective representation, a) with a closed flap and b) with a pivoted open flap.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A known method for controlling a motorized flap assembly is disclosed in US 2017/0089112 A1, that includes a drive arrangement with a spindle drive arranged in the flap is used. With this, motorized adjustment of the flap is possible at the request of the operator. However, it cannot be ruled out here that an unwanted, motorized closing process takes place, although the flap is still occupied by an object, such as by a person. This results in the risk of damage to property and personal injury, which is to be understood as an impairment of the operational safety of the flap assembly.

The present disclosure attempts to resolve one or more of the above-mentioned issues.

The method according to the proposal is used to control a motorized flap assembly 1 of a motor vehicle. In one or more embodiments, the motor vehicle is a pickup truck. Other variants of motor vehicles with a flap 2 which may be pivoted into a horizontal open position are also suitable for the application of the solution according to the proposal.

In addition to the flap 2, which may be pivoted around a flap axis 2*a* here, the flap assembly 1 has a drive arrangement 3 associated with the flap 2 and a control arrangement 4 for controlling the drive arrangement 3. In this case and preferably, the drive arrangement 3 has a spindle drive 5 arranged in the flap 2, which is coupled to the motor vehicle body by transmission kinematics 6. With regard to structural details of a design according to the proposal of the flap assembly 1, such as the spindle drive 5, reference may be made to US 2017/0089112 A1, which originates from the applicant and which is hereby incorporated by reference.

A position sensor 7 for determining position information related to the position of a selected component of the flap assembly 1 is associated with the flap assembly 1. In this case, the selected component, which relates to the position information, may be a drive shaft 8 of an electric drive motor 9 of the spindle drive 5.

The drive arrangement 3 may be designed to be reversible, so that a non-motorized, manual adjustment of the flap 2 by the introduction of a manual actuating force into the flap 2 causes a reversal of at least a part of the drive train of the drive arrangement 3. Thus, the occupancy of the flap 2 by an object can be easily detected, as is yet to be explained.

As one example, by means of the control arrangement 4 movement commands for the drive arrangement 3 are generated to close the flap 2 in an upright closed position (FIG. 1*a*) during a motorized closing process and to open it in a horizontal open position (FIG. 1*b*) during a motorized opening process. The terms "upright" and "horizontal" generally mean that the flap 2 is oriented with its flat side vertical or horizontal to a first approximation. In that the flap 2 is adjusted as part of the motorized opening process from the upright closed position downwards into the horizontal open position, the flap 2 pivoted open in this way may serve as a shelf, as a seat bench or the like.

The control of the drive arrangement 3 may be carried out without sensors. However, the drive arrangement 3 may be controlled by means of the control arrangement 4 based on the position information. As a result it is possible to approach movement profiles, but also exact positions of the flap 2, controlled by means of a control loop.

As mentioned above and shown in FIG. 1*b*, the mechanical arrangement is such that the pivoted open flap 2 may be occupied by an object, such as a person. This means that the object, in this case the person, rests or sits on the horizontal flap 2.

The occupancy state of the pivoted open flap 2 may be detected by the control arrangement 4 by means of the position sensor 7 according to at least one occupancy criterion and an occupancy reaction is triggered depending on the detected occupancy state.

In detail, the "occupied" occupancy state (FIG. 1*b*) may be considered to be detected if the at least one occupancy criterion is met. Otherwise the "unoccupied" occupancy state (FIG. 1*a*) is considered to be detected. This distinction between the "occupied" occupancy state and the "unoccupied" occupancy state is made with relatively little effort by control technology on the basis of the at least one occupancy criterion. In order to increase occupancy state detection reliability, it may also be provided that the "occupied" occupancy state is only considered detected if in addition at least one plausibility criterion is met. The plausibility criterion may be defined, for example, in that in the "occupied" occupancy state a motorized adjustment of the flap 2 in the closing direction may only be possible with increased drive current. Another plausibility criterion may be the assessment of the sensor information of other sensors, which are associated with an anti-pinch function, for example.

A relatively comfortable triggering of the motorized closing movement or the motorized opening movement results in that a gesture sensor 10 is monitored by the control arrangement 4 for the occurrence of a predetermined operator gesture during gesture recognition and thereupon the motorized closing process or the motorized opening process is triggered. The operator gesture may be, for example, a foot movement of a person standing in front of the flap 2. As an example, the foot movement is a so-called "kicking movement", which may be directed towards the flap 2. It may be seen from the representation according to FIG. 2 that the detection range 11 of the gesture sensor 10 in one or more embodiments, at least partly includes the legs of a person sitting on the pivoted open flap 2. Here the detection of the occupancy state of the flap 2 according to the proposal may be used to be able to avoid an unwanted motorized closing process. This has already been explained above.

In the exemplary embodiments which have been shown the position sensor 7 has a position sensor element 12, which may be configured to determine a position of the selected component. As an example, the selected component is a drive component, such as the drive shaft 8, of the drive arrangement 3, in this case of the drive motor 9 of the spindle drive 5. Here, the aforementioned reversibility may be advantageous, since any movement that is due to the occupancy of the pivoted open flap 2 by an object is passed through to the drive component, in this case the drive shaft 8.

In a relatively cost-effective and at the same time robust variant, the position sensor element 12 is a Hall sensor element. Then the selected component, in this case the drive shaft 8, may be appropriately equipped with a magnetic arrangement 13.

Alternatively or additionally, the position sensor 7 may have an inclination sensor element 14 for determining the inclination of the selected component. This is shown schematically in FIG. 1. In this case, the inclination sensor element 14 may be arranged in the flap 2, so that the selected component of the flap assembly 1 which is related to the determined position information is accordingly the flap 2 itself. The inclination sensor element 14 may be an inertial sensor element, which may be designed such as a MEMS sensor element. It is assumed from this below that only an aforementioned position sensor element 12 in the form of a Hall sensor element is provided.

In the represented embodiments, an overtravel movement 15 from the open position (shown in a solid line) to an overtravel position (shown in a dashed line) may be produced by the transition from the "unoccupied" occupancy state to the "occupied" occupancy state. In this case, an occupancy criterion may be defined in that the overtravel movement 15 and/or the overtravel position is detected by the control arrangement 4 by means of the position sensor 7. As an example, meeting this occupancy criterion is sufficient for considering the "occupied" occupancy state to be detected.

The open position and the overtravel position are located immediately adjacent to each other in relation to a pivoting movement of the flap 2 around the flap axis 2*a*. As an example, the open position and the overtravel position are spaced apart from each other by less than 5°, or by less than 3°, or by less than 2°, in each case in relation to the swivel axis 2*a* of the flap 2. Alternatively or additionally, it may be that during the transition from the open position to the overtravel position the free edge of the flap 2 opposite the swivel axis 2*a* is offset, such as lowered, by less than 20 mm, or by less than 10 mm, or by less than 5 mm.

During a motorized opening process, the flap 2 approaches the horizontal open position, which is shown in the drawing with a solid line. This may be realized so that during the motorized opening process, the open position of the flap 2 before the overtravel position when seen from the closed position—is approached purely by control technology by the control arrangement 4 by the position sensor 7. The term "purely by control technology" means that the open position is approached solely based on the position information and without the need to approach a stop. Here, a predetermined movement process may be implemented according to a type of soft stop, in which the speed is successively reduced until reaching the open position. Alternatively, it may be provided that during the motorized opening process the open position of the flap 2 before the overtravel position is mechanically approached against a stop 16 by the control arrangement 4 in block mode. The first-mentioned variant of the purely control technology approach to the open position may be provided in FIG. 2*a*, while approaching the open position in block mode is shown in FIG. 2*b*.

As an example, the adjustability of the flap 2 from the open position to the overtravel position may be provided in the manner of mechanical play or freewheeling and without resilience. In the sense of a smooth transition from the open position and the overtravel position, however, it may be provided that when the flap 2 is in the open position at least part of the flap assembly 1 has flexibility further in the pivoting direction of the flap 2 and that as a result the overtravel movement 15 detected by the control arrangement 4 by the position sensor 7 during the transition from the "unoccupied" occupancy state to the "occupied" occupancy state may be due to a resilient deformation of at least part of the flap assembly 1.

In the representation according to FIG. 2*a*, the flexibility of the flap assembly 1 is due to the flexibility of a spring arrangement 17, while the flexibility of the flap assembly 1 in the exemplary embodiment shown in FIG. 2*b* is due to the resilient flexibility of at least one structural component of the flap assembly 1, such as of the stop 16.

In both illustrated, and in this respect preferred, exemplary embodiments, resilient flexibility is provided such that after the end of occupancy of the flap 2 by the object, in this case the person, restoring the flap 2 in its closing direction from the overtravel position back to the open position is carried out.

Figure 2:
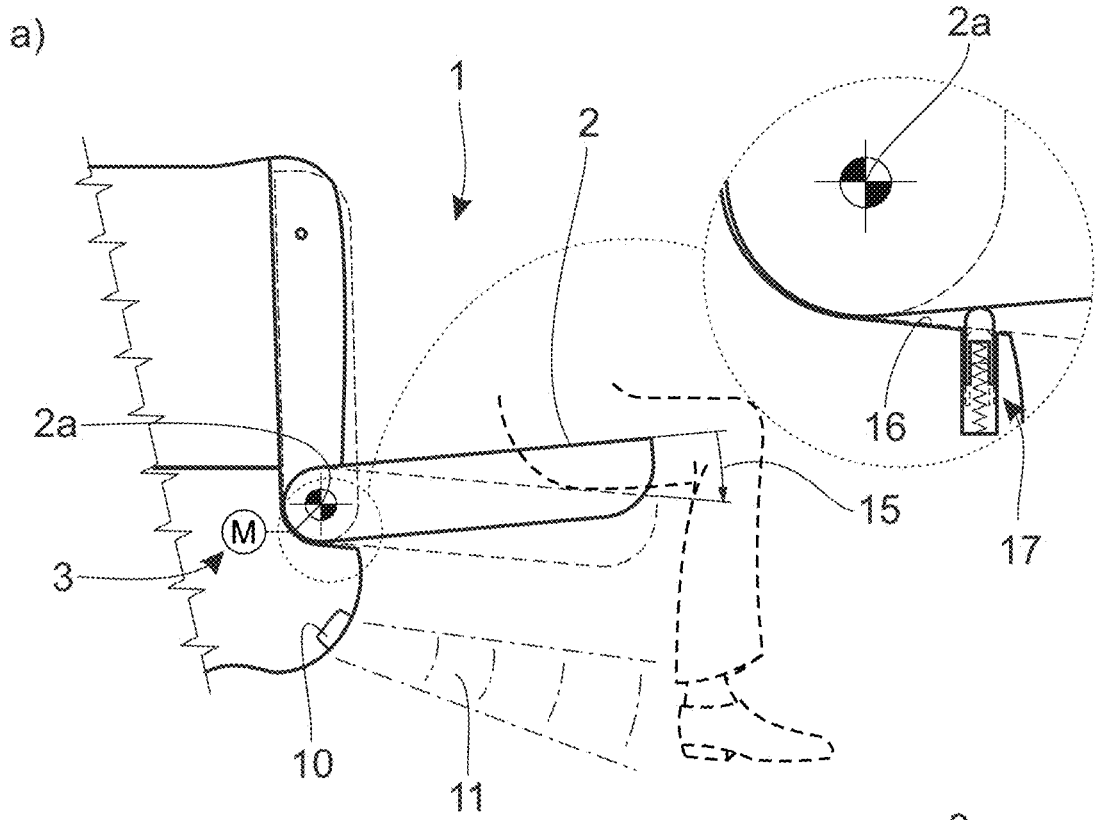
FIG. 2 shows the rear area of the motor vehicle according to FIG. 1*b* in a detailed side view a) according to a first embodiment and b) according to a second embodiment.
Figure 2:
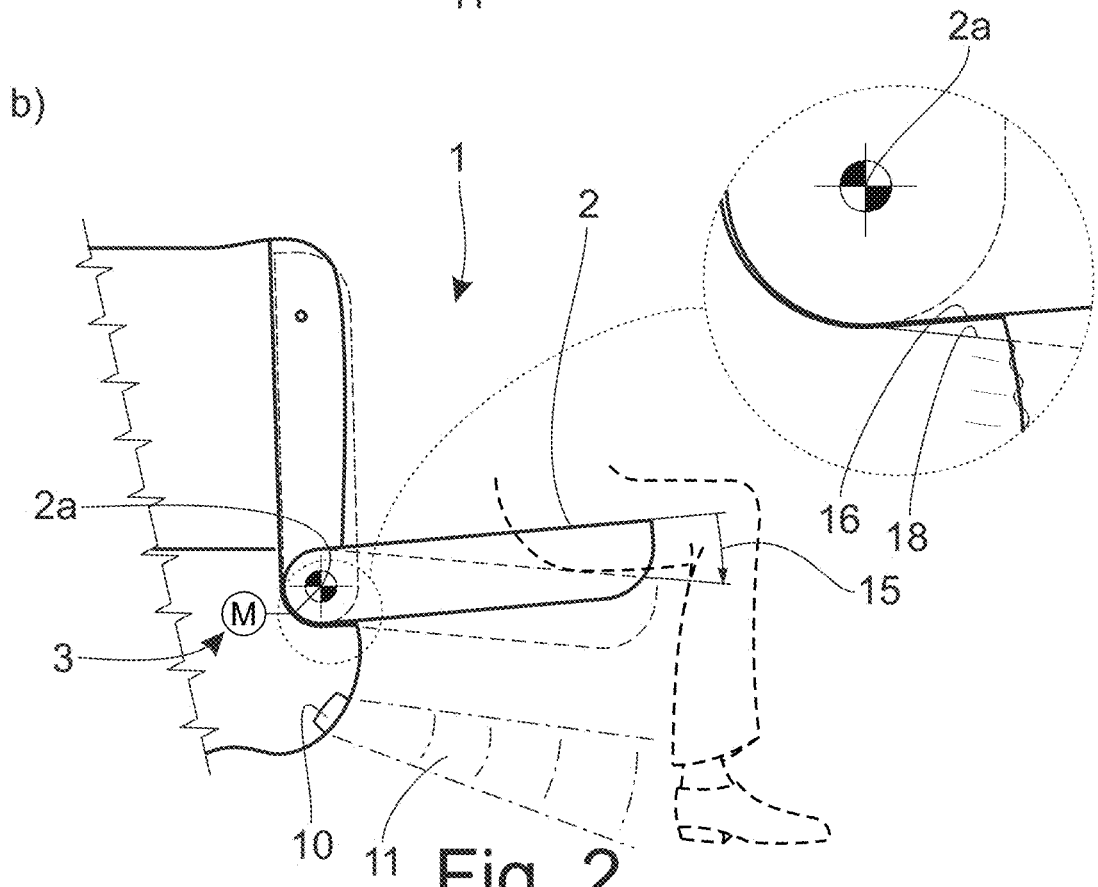

In both exemplary embodiments shown in FIG. 2, it is further necessary that an end stop 18 is provided, which defines the overtravel position of the flap 2. This end stop 18 is a hard end stop, which does not allow adjustment of the flap 2 in the closing direction of the flap 2 beyond the overtravel position.

The respective detected occupancy state of the flap 2 may be reacted to in a different way with a corresponding occupancy reaction. As an example, an occupied message is output to an operator interface or to another control arrangement as an occupancy reaction to the detection of the "occupied" occupancy state. An operator interface may in the present case be quite generally a kind of output unit, which may be arranged on the motor vehicle, on a radio key or the like. The further control arrangement may be, for example, a central, higher-level control arrangement of the motor vehicle.

Alternatively or additionally, suspension of the control of the drive arrangement 3 may be provided as an occupancy reaction, so that material damage or personal injury, which could be due to the occupancy of the flap 2, is excluded. Further alternatively or additionally, suspension of gesture recognition may be provided as an occupancy reaction, so that the faulty detection of a gesture, which is caused, for example, by dangling the legs of a person sitting on the flap 2, is excluded. The above suspension of control of the drive arrangement 3 and/or the above suspension of gesture recognition may be maintained until the occupancy of the flap 2 is removed.

As an example, it may also be provided that on detection of the "occupied" occupancy state and in addition on the generation of a movement command for the closing process, the occupancy reaction is the suspension of the closing process and/or an occupied flap movement message to an operator interface or to another control arrangement. Thus, in any case it is initially prevented that a motorized closing process is carried out, although the "occupied" occupancy state has been detected.

However, the detection according to the proposal of the occupancy state of the flap 2 may also be advantageous in the situation in which the motor vehicle is in the drive mode. For this purpose, it may be provided that on detection of the "occupied" occupancy state and in addition on the triggering of the drive mode of the motor vehicle, the occupancy reaction is the suspension of the drive mode and/or an occupied drive mode message to an operator interface or to a further control arrangement. Here, if appropriate, further sensor information, for example the sensor information of a pinch protection sensor 20, 21 of a pinch protection arrangement 19, may be used to check whether the detected occupancy state is to be classified as permissible. An example of this is the transport of wooden beams which protrude beyond the loading area and thus rest on the flap 2. In this case, the occupancy reaction may be suspended.

Alternatively or additionally, it may be provided that on detection of the "unoccupied" occupancy state of the pivoted open flap 2 and in addition on the triggering of the drive mode of the motor vehicle, the occupancy reaction is the suspension of the drive mode and/or an unoccupied drive mode message to an operator interface or to a further control arrangement. In this case it may be provided that the suspension, in this case of the drive mode, is maintained only until the pivoted open state of the flap 2 is cancelled.

Further alternatively or additionally, on detection of the "unoccupied" occupancy state of the pivoted open flap 2 and additionally on the triggering of the drive mode of the motor vehicle, the occupancy reaction may be triggering of the motorized closing process of the flap 2, so that the pivoted open state of the flap 2 is automatically cancelled. This motorized closing process may still take place before the start of drive mode or during the drive mode.

In one or more embodiments, the occupied message and/or the occupied flap movement message and/or the occupied drive mode message and/or the unoccupied drive mode message are different from each other, so that a distinction of the messages in question is possible. Further it may be provided that the occupied message and/or the occupied flap movement message and/or the occupied drive mode message and/or the unoccupied drive mode message triggers or trigger an acoustic and/or optical message via the operator interface.

The detection according to the proposal of the occupancy state of the flap 2 may also be used in the context of an aforementioned pinch protection function. In detail, it may be provided that the flap assembly 1 has an also already mentioned pinch protection arrangement 19, that may include at least one pinch protection sensor 20, 21, which monitors the motorized closing process and/or the motorized opening process for a predetermined pinch case. The monitoring sensitivity may be adjusted depending on the respective detected occupancy state of the flap 2.

According to one or more embodiments, which has independent importance, a computer program product for a control arrangement 4 is provided. The computer program product has commands which, during the execution of the program by a computer of the control arrangement 4 of the flap assembly, cause this to detect the occupancy state of the pivoted open flap 2 by the position sensor 7 and to trigger an occupancy reaction depending on the detected occupancy state. All statements relating to the method according to the proposal may be referred to.

According to one or more embodiments, which also has independent importance, a computer-readable storage medium, on which the computer program product according to the proposal is stored, may be in a non-volatile manner. In this respect, too, reference may be made to all statements relating to the method according to the proposal.

According to one or more embodiments, which also has independent importance, the motorized flap assembly 1 of the motor vehicle is provided. In this respect, too, reference may be made to all statements relating to the method according to the proposal, insofar as they are suitable for explaining the flap assembly 1.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

LIST OF REFERENCE NUMBERS

1 flap assembly
2 flap
3 drive arrangement
4 control arrangement
5 spindle drive
6 transmission kinematics
7 position sensor
8 drive shaft
9 electric drive motor
10 gesture sensor
11 detection range
12 position sensor element
13 magnetic arrangement
14 inclination sensor element
15 overtravel movement
16 stop
17 spring arrangement
18 end stop
19 pinch protection arrangement
20 pinch protection sensor
21 pinch protection sensor
2*a* flap axis While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A method of controlling a motorized flap assembly of a motor vehicle, the flap assembly including a pivotable flap, a drive arrangement configured to adjust the flap, and a control arrangement configured to control the drive arrangement, the method comprising:

determining, by a position sensor, position information related to a position of the flap assembly;

generating, by a control arrangement, movement commands for the drive arrangement to:

(1) move, by the drive arrangement executing a motorized closing process, the flap towards an upright closed position to close the flap, or (2) move, by the drive arrangement executing a motorized opening process, the flap towards a horizontal open position to open the flap, wherein the flip is configured to permit an object to be occupied by the flap;

detecting, collectively by the position sensor and the control arrangement, an occupancy state including an occupied state, wherein the object occupies the flap, based on at least one occupancy criterion; and triggering an occupancy reaction in response to the occupancy state.

2. The method of claim 1, wherein the occupancy state includes an unoccupied state, wherein the object does not occupy the flap, and the detecting step includes detecting the unoccupied state.

3. The method of claim 2, wherein in response to detection of the occupied state and generation of a movement command to execute the motorized closing process, the occupancy reaction includes suspending the closing process or an sending an occupied flap movement message to an operator interface or to another control arrangement.

4. The method of claim 2, further comprising:

triggering a drive mode of the motor vehicle;

suspending the drive mode or sending an occupied drive mode message to an operator interface or to another control arrangement or sending an unoccupied drive mode message to the operator interface or the other control arrangement.

5. The method of claim 4, further comprising:

triggering an acoustic or optical message via the operator interface in response to triggering the drive mode.

6. The method of claim 2, wherein the occupied occupancy state is only considered to be detected if in addition to at least one plausibility criterion is met.

7. The method of claim 1, further comprising:

monitoring, by the control arrangement, a gesture sensor configured to detect a predetermined operator gesture; and triggering the motorized closing process or the motorized opening process in response to the gesture sensor detecting the predetermined operator gesture.

8. The method of claim 7, wherein the occupancy reaction includes:

sending an occupied message to an operator interface, or sending the occupied message to another control arrangement; or suspending control of the drive arrangement, or suspending the monitoring step.

9. The method of claim 1, wherein the determining step includes determining a position of a drive component of the drive arrangement.

10. The method of claim 9, wherein the determining step includes determining a position of a drive shaft of the drive arrangement.

11. The method of claim 1, further comprising:

determining, by an inclination sensor, an inclination of the flap assembly.

12. The method of claim 1, wherein the detecting step includes detecting the flap moving, in response to an overtravel movement of the flap from the open position to an overtravel position, wherein the at least one occupancy criterion includes detecting the overtravel movement or the overtravel position.

13. The method of claim 12, wherein executing the motorized opening process includes:

commanding the drive arrangement to stop the flap in the open position before the flap reaches the overtravel position based on the position information received from the position sensor, or commanding the drive arrangement to change to a block mode to stop the flap before the flap reaches the overtravel position in response to the flap moving mechanically against a stop.

14. The method of claim 12, wherein the flap moving from the open position to the overtravel position includes a part of the flap assembly resiliently deforming and the at least one occupancy criterion includes resilient deformation of the part.

15. The method of claim 1, wherein the generating step is based on the position information.

* * * * *